United States Patent [19]

Baker et al.

[11] Patent Number: 5,044,680

[45] Date of Patent: Sep. 3, 1991

[54] DOOR HOLDER POWER SUPPLY ACCESS MEMBER

[75] Inventors: William Baker; Raymond G. Benson, Jr.; Robert C. Gudgel, all of Indianapolis, Ind.

[73] Assignee: Motus Incorporated, Indianapolis, Ind.

[21] Appl. No.: 577,525

[22] Filed: Sep. 5, 1990

Related U.S. Application Data

[63] Continuation-in-part of Ser. No. 416,929, Oct. 4, 1989.

[51] Int. Cl.[5] ..... E05C 17/08

[52] U.S. Cl. ..... 292/278; 49/31; 49/379

[58] Field of Search ..... 292/278; 49/31, 379; 354/288 E; 340/825.16, 568

[56] References Cited

U.S. PATENT DOCUMENTS 1,994,940 3/1935 Butters ..... 292/278
3,153,774 10/1964 Mylie ..... 340/815.17 X
3,771,823 11/1973 Schnaar ..... 49/379 X
4,040,143 8/1977 Lasier et al. ..... 16/48 J
4,506,407 3/1985 Downey ..... 16/48.5

FOREIGN PATENT DOCUMENTS 3444223 6/1986 Fed. Rep. of Germany ..... 70/279

*Primary Examiner*—Lloyd A. Gall
*Attorney, Agent, or Firm*—Baker & Daniels

[57] ABSTRACT

A door hold open device for use with fire doors connected to a door closer unit. The hold open device has a latching means that automatically unlatches if the power supply drops below a predetermined threshold or a person attempts to disconnect the power supply. The device includes an electrical actuating means for unlatching the held open door. The actuating means allows a door to be latched open without constant current being supplied to the actuating means, so battery power is possible. The invention may be used with any door closer unit, does not require special wiring, and may include a self-contained power supply and an integral smoke detector.

5 Claims, 4 Drawing Sheets

DOOR HOLDER POWER SUPPLY ACCESS MEMBER

RELATED APPLICATION

This is a continuation-in-part of copending application Ser. No. 07/416,929, filed Oct. 4, 1989.

FIELD OF INVENTION

This invention relates to an automatically releasable, electrically actuated, door hold-open device that releasably holds open a door attached to a door closer. The held-open door may be manually released by applying a moderate closing force to the door. Otherwise, an electric actuator releases the held-open door when a predetermined condition occurs, such as the detection of smoke or a power outage.

BACKGROUND OF THE INVENTION

Many releasable door hold-open devices are known in the art for automatically releasing a held-open door when a predetermined condition is detected, such as the existence of smoke or heat. These devices are often used with fire doors, which must be closed in the event of a fire to inhibit spreading of the fire.

Most prior devices use a solenoid that must be continually energized to hold open the door. Examples of such devices are disclosed in representative U.S. Pat. Nos. 3,729,771, 3,771,823, 3,905,063 and 4,040,143. When smoke or heat is detected, or if current to the device is interrupted, the solenoid is de-energized, thus automatically releasing the door and allowing it to close under the force of a door closer. This implementation has the distinct disadvantage of requiring the electric actuator to be continuously energized to hold the door in the open position. A continuously energized actuator draws a large continuous electrical current, which wastes electricity, decreases the life of the actuator and makes battery operation impractical.

The method of wiring such prior devices presents additional problems. A continuous current requires wiring the door hold-open device to the main power supply of the building, which is expensive, particularly for older building which must be retrofitted. Since the electric actuators in many prior devices do not run off a typical 120 volt electrical supply, special transformers and wiring are required, again at additional cost. In addition, when multiple door hold open devices are wired to a common fire or smoke alarm, the wire connections for different devices are often different. For example, the first, last and intermediate devices in a series of devices must often be wired differently. This causes confusion and frequently results in incorrect wire connections.

Since prior hold-open devices are usually connected to a central electrical source, the devices are subject to damage from power surges caused by lightening strikes and power surges from the electric supply.

Another problem faced by prior hold open devices occurs when they are wired to a common smoke or fire detector. An alarm condition may result in the release of all doors wired to the system, even though many of those doors may not be near the fire or smoke.

Because prior hold-open devices typically employ a remote power source, doors will be released if a power failure occurs, even if no fire is present. After the power is restored, each unit having a smoke detector must be individually reset before it will hold the door open. This is an inconvenient and time-consuming task.

Finally, many prior hold open devices can accommodate only one type of door-closer unit. This increases the cost of the unit because the purchaser must also pay for the closer unit. There is a felt need for a universal hold-open device that can be installed in conjunction with any type of preexisting door closer.

U.S. Pat. Nos. 4,506,407, 4,656,690 and 4,715,146, disclose automatically releasable hold-open devices that allow a door to latch open while the actuating device is not energized. However, these devices suffer from an even greater defect. Should the power supply to the device fail, a latched-open door will not be released. Most building codes require that door hold-open devices include a fail-safe feature to automatically release a door upon interruption of the power source. While a battery power supply is practical for this type of hold-open device, it is not safe because the battery may, without warning, become so discharged that it cannot provide sufficient electromotive force to release the door. Thus, if the power fails before the device detects smoke or heat, the door will remain open allowing a fire to spread more rapidly.

OBJECTS OF THE INVENTION

One object of the invention is to provide an automatically releasable door hold open device that does not require a continuous current to the actuating device to latch open a door.

Another object of the invention is to provide an automatically releasable door hold open device that does not require special wiring to the building in which the device is installed.

Another object of the invention is to provide an automatically releasable door hold open device that may be used with any door closer apparatus.

Another object of the invention is to provide an automatically releasable door hold open device that can be powered by a battery.

Another object of the invention is to provide an automatically releasable door hold open device having an integral smoke detector.

Another object of the invention is to provide a door hold open device that will release a door when the battery's voltage drops below a predetermined threshold, or when the battery is removed.

Another object of the invention is to provide a door hold open device that will allow a door to be held open at an angle of 180°.

Still other objects and advantages of the invention will become apparent to those of skill in the art after reading the following description of a preferred embodiment.

SUMMARY OF THE INVENTION

The invention is a door hold open device for use with fire doors connected to a door-closer unit. The hold open device has a latching means that automatically unlatches if the power supply drops below a predetermined threshold or a person attempts to disconnect the power supply. The device includes an electrical actuating means for unlatching the held-open door. The actuating means allows a door to be latched open without constant current being supplied to the actuating means, so battery power is possible. The invention may be used with any door-closer unit, and does not require special wiring.

DESCRIPTION OF THE PREFERRED EMBODIMENT

Figure 1:
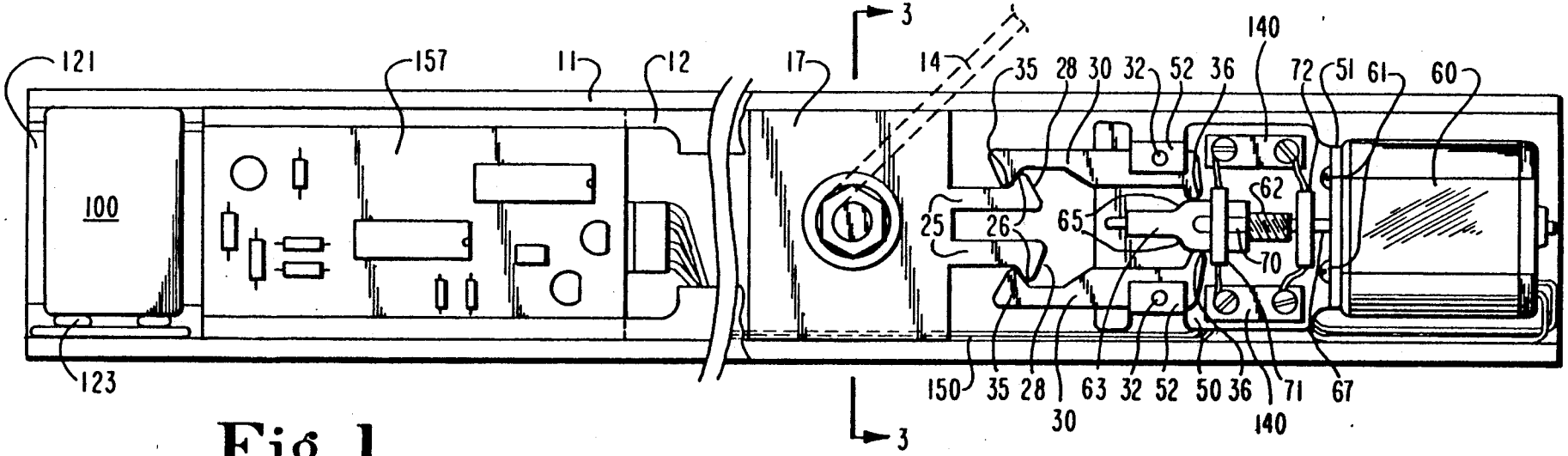
FIG. 1 is a top partial section showing a door hold open device in a latched position.

Referring to FIG. 1, in the preferred embodiment, the device of the invention includes elongate housing generally designated as 11. Housing 11 includes track 12 along which reciprocating member 17 may slide. Reciprocating member 17 receives rod 14, and also translates the degree of the door's open or closed position to a point along the rectilinear path of track 12. It should be understood the preferred embodiment of the present invention is intended to be used with a door having a separate door closer (not shown) which continuously urges the door toward a closed position. However, it is within the scope of the invention to integrate a door closer component within the housing used for the present hold open device.

Figure 3:
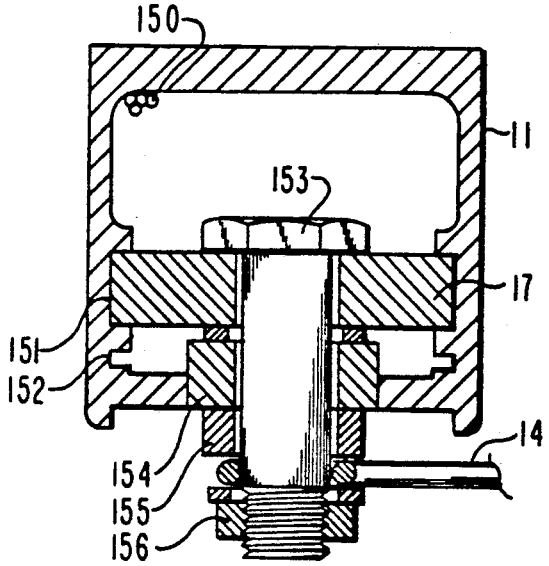
FIG. 3 is a section of the housing of the invention showing the position of the reciprocating member in the track of the housing.
Figure 4:
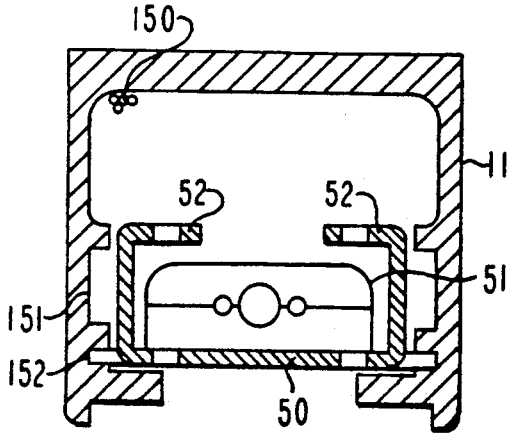
FIG. 4 is a section of the housing of the invention showing the position of the hardware and motor mount in the track of the housing.

The position of reciprocating member 17 within housing 11 may be further understood with reference to FIG. 3. Housing 11 contains two symmetrical tracks 151 and 152. Track 151 holds reciprocating member 17, through which bolt 153 passes. Bolt 153 holds guide washer 154, spacer 155 rod 14, all of which are held in place by nut 156. As shown in FIG. 4, track 152 is narrower than track 151, and receives base plate 50 at one end of housing 11, and circuit board 157 at the opposite end (see FIG. 1). Electrical wires 150 also traverse the interior housing, to connect circuit board 157 to motor 60 and magnetically operated reed switches 71 and 72.

Reciprocating member 17 has two resilient fingers which extend toward pivotable latch arms 30 and serve as latch arm receiving means. These fingers may comprise nylon or plastic, or any other material which is somewhat stiff yet resilient. The end of each finger contains an outward protrusion 26. The edge of each protrusion closest to the center of reciprocating member 17 is a convex arc with a radius of ⅛ inch. The arc swings out from the outsides of fingers 25. The tips of fingers 25 comprise 45° ramps 28.

Figure 2:
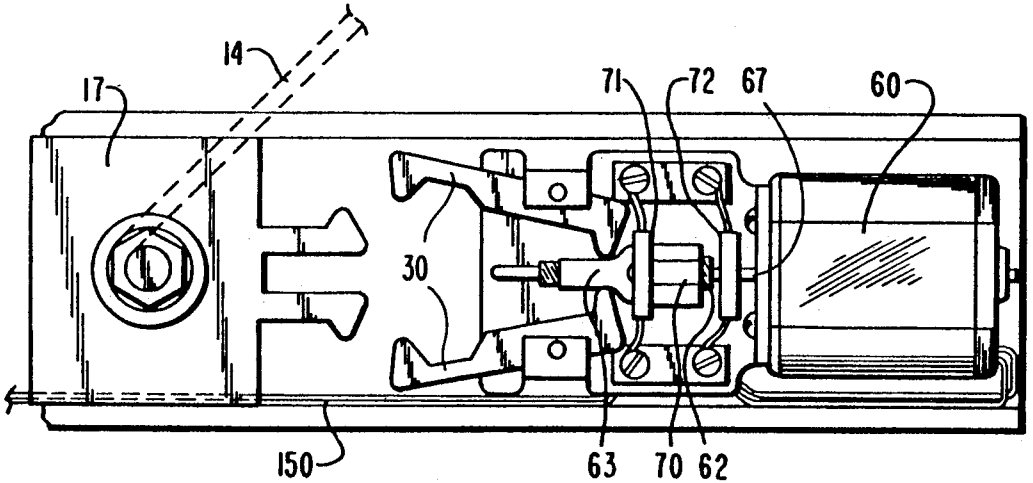
FIG. 2 is a top partial section showing a door hold open device in an unlatched position.

As the door moves from a closed to an open position, rod 14 translates the door's movement to reciprocating member 17 which moves from the unlatched position shown in FIG. 2 to the latched position shown in FIG. 1. Fingers 25 are positioned to engage latch arms 30 and thereby keep reciprocating member 17 in a hold open position. The latching mechanism is operated by a DC motor 60 connected to a battery 100 through electronic circuity described in detail later.

The latching mechanism includes a pair of latch arms 30 pivotally mounted on base 50 by pins 32. Base 50 is formed from a single piece of sheet metal, and includes flanges 52 which extend upward and partially cover latch arms 30. Pins 32 each extend from flanges 52, through arms 30, and into base 50. The pivot point of each latch arm is such that when the latching mechanism is in the unlatched position, as shown in FIG. 2, the protrusions of arms 30 are separated by a distance greater than the width of fingers 25. The ends of latch arms 30 closest to reciprocating member 17 contain inward protrusions 35. Protrusions 35 are defined by a concave arc with a radius of ⅛ inch, and mate with the protrusions 26 of fingers 25. The inside of protrusions 35 include ramps at an angle of 45 degrees from the outside of latch arms 30. The tips of latch arms 30 are rounded. The ends of latch arms 30 opposite the latching ends contain small inwardly-facing posterior protrusions 36.

A DC motor 60 is mounted on a flange 51 projecting perpendicular to base 50 and is secured thereto by screws 61. DC motor's rotating shaft 67 includes externally threaded rod 62 which extends between latch arms 30 equidistant from each arm. Cam 63 includes internal threads to receive threaded rod 62. By actuating DC motor 60, cam 63 is reciprocably inserted and withdrawn from between posterior protrusions 36 of latch arms 30. If DC motor 60 is energized to rotate shaft 67 in a counterclockwise direction, cam 63 will be driven away from motor 60, from the position shown in FIG. 2 to the position shown in FIG. 1. Tapered sides 65 of cam 63 will engage posterior protrusions 36, forcing them outward. As cam 63 advances, the latching end of latch arms 30 are forced inward around the fulcrum of the mounting pivot pins 32. When DC motor 60 is energized to rotate shaft 67 in a clockwise direction, cam 63 is withdrawn from between the posterior protrusions 36, allowing latch arms 30 to move freely.

With cam 63 fully inserted between posterior protrusions 36 as shown in FIG. 1, a door may be latched open. This is accomplished by opening the door, thus forcing reciprocating member 17 toward motor 60, until fingers 25 reach latch arms 30. At that point, a slight additional opening force must be applied to the door to force resilient fingers 25 toward each other and between latch arms 30. Once the protrusions 26 on resilient fingers 25 have passed protrusions 35 of latch arms 30, reciprocating member 17 will be latched as shown in FIG. 1. This results in holding the door open until cam 63 is withdrawn, allowing latch arms 30 to pivot freely. At this point, the bias of door closer (not shown) will begin to close the door, moving reciprocating member 17 away from motor 60. This motion will cause fingers 25 to push latch arms 30 outward, unlatching reciprocating member 17.

Even when the hold open device is in its latched position as shown in FIG. 1, the door may be closed by manually applying a closing force to the door sufficient to cause resilient fingers 25 to cam inward slightly as reciprocating element 17 moves away from DC motor 60. Once fingers 25 are beyond protrusions 26, the door will continue to close under the bias of the door closer (not shown).

With reference to FIG. 1, it may be appreciated that the preferred embodiment of the present invention includes means for deactivating motor 60 once it has been actuated. In particular, cam 63 has glued thereon magnet 70. Positioned above the path of cam 63 are first and second reed switches 71 and 72, which are mounted to base 50 by insulating blocks 140. The locations of reed switches 71 and 72 are such that they are directly over magnet 70 when cam 63 is in the latched (FIG. 1) and unlatched (FIG. 2) positions, respectively. Thus, once motor 60 has been actuated to drive cam 63 in either direction, reed switches serve to detect when the cam 63 has moved far enough to require that motor 60 be deenergized.

Figure 5:
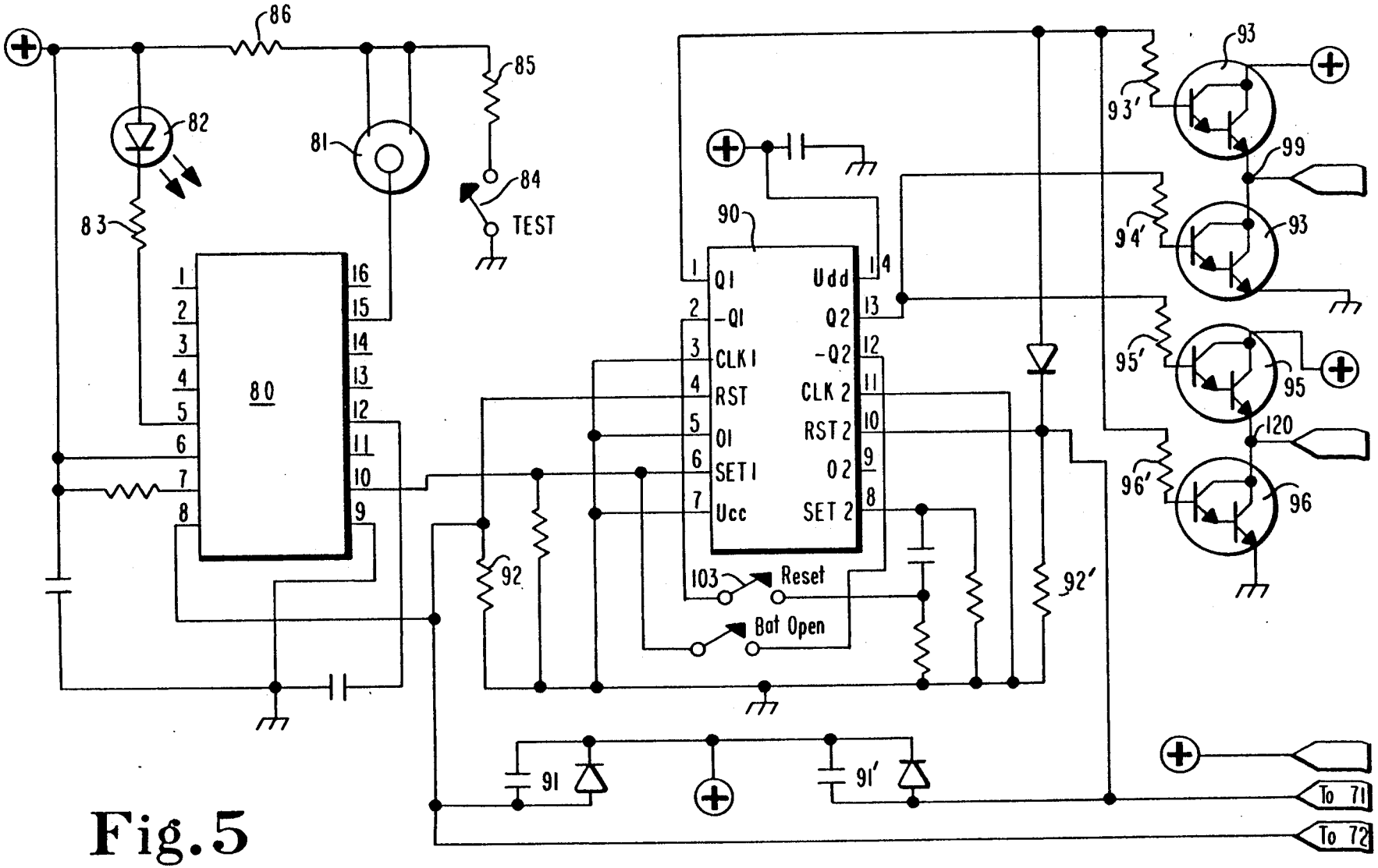
FIG. 5 is a circuit diagram of the door hold open device.

A primary feature of the present invention is that the above-described latch will move to an unlatched position not only when smoke is detected, but also when the voltage of the power source falls below a predefined threshold. As shown in FIG. 5, a commercially available smoke detector integrated circuit chip 80 (Motorola 14467-1) drives one side of a dual flip flop 90. Pin 15 of smoke detector chip 80 receives an input voltage from a particle detector 81. Input pin 15 of smoke detector chip 80 will receive a low when particle detector 81 does not detect smoke. When particle detector 81 detects smoke, pin 15 of smoke detector chip 80 will receive a high. When pin 15 of smoke detector chip 80 receives a high, pin 10 of smoke detector chip 80 outputs a train of high pulses.

Pin 5 of smoke detector chip 80 is tied to the positive terminal of battery 100 through LED 82 in series with a 150 ohm current limiting resistor 83. Pin 5 of smoke detector chip 80 is temporarily set low on periodic intervals by smoke detector chip 80 to allow current to flow through LED 82 and resistor 83. This causes LED 82 to emit a strobe of light. Smoke detector chip 80 internally measures the voltage of battery 100 from the current flowing into pin 5. Pin 10 of smoke detector chip 80 also outputs a train of high pulses when the voltage of battery 100 drops below 7 volts. Pin 10 of smoke detector chip 80 is connected to pin 6 of dual flip flop 90 (CD4013). Pin 1 of dual flip flop 90 is the output of the first flip flop, and pin 13 is the output of the second flip flop. When power is initially applied to the circuitry, the output of pins 1 and 13 of dual flip flop 90 are latched low in the following manner. When pin 4 of dual flip flop 90 receives a high, pin 1 of dual flip flop 90 is latched low until pin 6 of dual flip flop 90 receives a high. Likewise, when pin 10 of dual flip flop 90 receives a high, pin 13 of dual flip flop 90 is latched low until pin 8 of dual flip flop 90 receives a high.

On initial power-up, pin 4 of dual flip flop 90 is tied high by a combination of a reversed biased diode in parallel with a capacitor 91 in series with the positive terminal of battery 100. This causes pin 1 of dual flip flop 90 to be latched low. A millisecond later, the capacitor becomes fully charged and combination 91 becomes an open circuit to DC current. Pin 4 of dual flip flop 90 is then tied to ground through 10K ohm current limiting resistor 92.

Also on initial power-up, pin 10 of dual flip flop 90 is tied high by a combination of a reversed biased diode in parallel with a capacitor 91' in series with the positive terminal of battery 100. This causes pin 13 of dual flip flop 90 to be latched low. A millisecond later, the capacitor becomes fully charged and combination 91' becomes an open circuit to DC current. Pin 10 of dual flip flop 90 is then tied to ground through 10K ohm current limiting resistor 92'.

A darlington pair npn transistor 93 has its collector tied high. A darlington pair npn transistor 94 has its collector tied to the emitter of darlington transistor 93 at node 99. The emitter of darlington transistor 94 is tied to ground.

Likewise, a darlington pair npn transistor 95 has its collector tied high. A darlington pair npn transistor 96 has its collector tied to the emitter of darlington transistor 95 at node 120. The emitter of darlington transistor 96 is tied to ground.

The bases of darlington transistors 93 and 96 are tied to pin 1 of dual flip flop 90 through resistors 93' and 96', respectively. The bases of darlington transistors 94 and 95 are tied to pin 13 of dual flip flop 90 through resistors 94' and 95', respectively.

On initial power up, pins 1 and 13 of dual flip flop 90 are latched low as described above. This prevents current from flowing through any of the darlington transistors, 93, 94, 95 and 96. When pin 6 of dual flip flop 90 receives a high, pin 1 of dual flip flop 90 is latched high until pin 4 of dual flip flop 90 receives a high. Pin 1 of dual flip flop 90 provides base current to darlington transistors 93 and 96. This allows current to flow from the collector to the emitter of darlington transistors 93 and 96. This creates a positive voltage between nodes 99 and 120. The DC motor 60 receives its power from nodes 99 and 120. The positive voltage at nodes 99 and 120 causes the DC motor 60 to rotate shaft 67 in a clockwise direction withdrawing cam 63 from between the posterior protrusions 36. This allows latch arms 30 to move freely, releasing fingers 25 and allowing the door close under the power of the door closer.

As shown in FIGS. 1 and 2, a permanent magnet 70 is affixed to cam 63. The positive terminal of battery 100 is connected to pin 4 of dual flip flop 90 through second reed switch 72. Second reed switch 72 is positioned across the path of cam 63 as shown in FIG. 2. Once the magnet 65 is sufficiently close to reed switch 72, the reed switch closes pulling pin 4 of dual flip flop 90 high. This causes pin 1 of dual flip flop 90 to be latched low, stopping current from flowing through darlington transistors 93 and 96. This turns off DC motor 60, stopping cam 63 from being withdrawn further.

In this state, a door cannot be latched open. To allow the invention to latch open a door, cam 63 must be inserted between the posterior protrusions 36. This is accomplished by reset switch 103 that must be manually depressed. Reset switch 103 closes a circuit from pin 2 to pin 8 of dual flip flop 90. Output of pin 2 of dual flip flop 90 is latched high only when pin 1 of dual flip flop 90 is latched low. In the state just described, pin 2 of dual flip flop 90 is latched high. When reset switch 103 is depressed, it momentarily pulls pin 8 of dual flip flop 90 high. When pin 8 of dual flip flop 90 receives a high, pin 13 of dual flip flop 90 is latched high until pin 10 of dual flip flop 90 receives a high. Pin 13 of dual flip flop 90 provides base current to darlington transistors 94 and 95. This allows current to flow from the collector to the emitter of darlington transistors 94 and 95. This creates a negative voltage between nodes 99 and 120. The negative voltage at nodes 99 and 120 causes DC motor 60 to rotate shaft 67 in a counterclockwise direction, inserting cam 63 between the posterior protrusions 36 and 36. This forces the latching ends of latch arms 30 inward around the fulcrum of pins 32, allowing latch arms 30 to latch fingers 25.

The positive terminal of battery 100 is connected to pin 10 of the dual flip flop 90 through first reed switch 71. First reed switch 71 is positioned across the path of cam 63 as shown in FIGS. 1 and 2. Once magnet 70 is sufficiently close to first reed switch 71, it closes pulling pin 10 of the dual flip flop 90 high. This causes pin 13 of dual flip flop 90 to be latched low, stopping current from flowing through darlington transistors 94 and 95. This turns off DC motor 60, stopping cam 63 from being inserted further.

It is obvious that if the invention is reset to a latch mode while a condition exists which causes the invention to unlatch, cam 63 will be automatically withdrawn as soon as it reaches its latch open position. This results because pin 6 of dual flip flop 90 will continue to receive a high and pin 4 of dual flip flop 90 will not be tied high through second reed switch 72 after cam 63 leaves the unlatched position.

Figure 6:
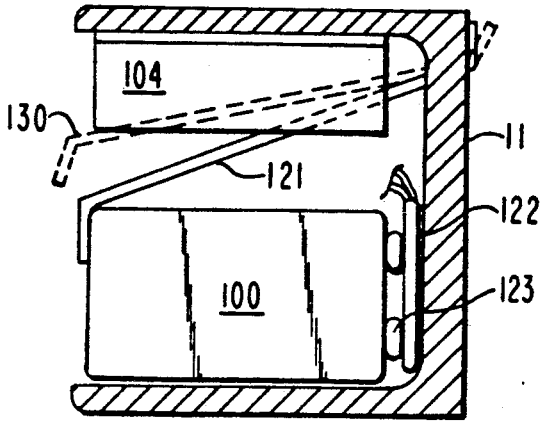
FIG. 6 is a side view of the battery access switch of the present invention.

Two final conditions will cause the invention to automatically unlatch. First, referring to FIG. 6, a mechanical switch 104 is connected to an access member comprising lever 121 attached to a battery compartment 122 housing a standard 9 volt battery 100. Before battery 100 may be grasped and thereby disconnected from electrical contacts 123, which comprise a power supply receiving means, lever 121 must be raised to the position designated as 130, which trips switch 104. In this state, switch 104 closes a circuit from pin 12 of dual flip flop 90 to pin 6 of dual flip flop 90. Pin 12 of dual flip flop 90 is high only when pin 13 of dual flip flop 90 is low. Once pin 6 of dual flip flop 90 receives a high, the invention operates as described above for the detection of smoke or low battery voltage, and the device is unlatched before battery 100 may be removed from compartment 122.

Figure 7:
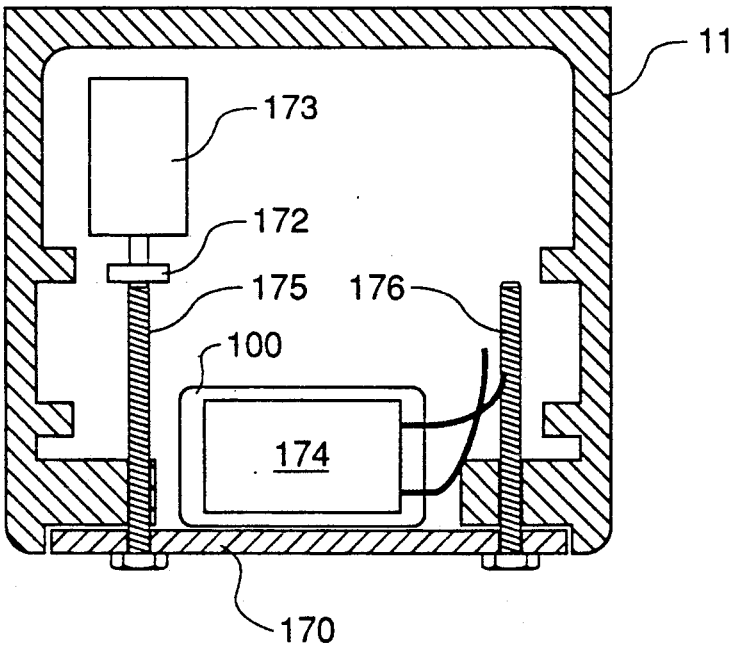
FIG. 7 is a partial section of another embodiment of a battery access member of the present invention.

An alternate battery access member is shown in FIG. 7. In this embodiment, screws 175 and 176 hold plate 170 to housing 11. Screw 175, which acts as a battery access member, is positioned to depress plunger 172 of switch 173 when screw 175 is fully screwed into housing 11. Before battery 100 may be disconnected from battery clip 174, screws 175 and 176 must be removed in order to separate plate 170 from housing 11. As screw 175 is retracted, switch 173 will trip, causing the door to become unlatched as described above.

The second condition that will cause the invention to automatically unlatch occurs when test switch 84 is depressed to complete a circuit from the positive terminal of battery 100 to the ground terminal of battery 100 through two-1M ohm resistors 86 and 85 wired in series. As shown in FIG. 5, input to particle detector 81 is connected via the first 1M ohm resistor 86 to the positive terminal of battery 100. When switch 84 is depressed, particle detector 81 generates a false smoke detection signal to pin 15 of smoke detector chip 80. Smoke detector chip 80 behaves as though smoke was detected and pin 10 of smoke detector chip 80 outputs a train of high pulses. The device then functions as previously described.

As noted above, the above components may be contained in a single housing.

It will be appreciated that numerous changes may be made to the embodiment disclosed herein without departing from the spirit and scope of the invention. For example, numerous latch mechanisms for door closers are known in the art and may be employed in place of the finger/latch arm combination described above. In particular, any latch mechanism based on the use of a reciprocating member could be replaced by the motor-threaded sleeve combination disclosed above. For example, such a reciprocating member could be inserted and retracted from a detent in a rotatable cylinder, as disclosed in U.S. Pat. Nos. 3,729,771 or 3,935,614. It is also contemplated that a door closer may be integrally constructed with a door hold open device, instead of using separate units. In addition, many other variations of power supply access members which trip a switch, including those based on movement, touch, capacitance, light and other techniques, may be used to cause unlatching of the door before disconnection of the power supply.

The above described preferred embodiment contains several advantages over the prior art. First, the use of a DC motor makes constant current to the electrical actuating element unnecessary. Second, since a large constant current is not needed, a battery may be used as a power source. This in turn makes wiring the device to a building's electrical supply unnecessary. Third, since the device is not wired to a building's electrical supply, it will not be damaged by power spikes, and the chances of incorrectly wiring of the device are eliminated. Fourth, the device will not unlatch if there is a power failure in the building. Fifth, if a fire occurs, only doors in the area of the fire will close, as remote doors will remain held open. Sixth, the switch on the battery compartment which releases the door from the held open position if the battery is removed, provides compliance with many fire codes, which demand that such devices unlatch when power to a door hold open device is interrupted. Additionally, the device may be used with any other door closer. Finally, the voltage threshold detector causes the device to unlatch a held-open door before the battery's voltage drops to a level where it is insufficient to power the unlatching mechanism.

Other modes of applying the principles of the invention are possible provided that the features stated in the following claims, or the equivalent of such, be employed.

We claim:

1. A releasable door hold open device, comprising:

a latching means for latching a door in an open position, a power supply receiving means capable of receiving power, an access member to the power supply receiving means, and unlatch means operatively connected to said access member to unlatch said latching means, before the power is disconnected from the power supply receiving means, when the access member is moved in such a manner so as to permit disconnection of power to the power supply receiving means.

2. The device of claim 1 wherein the access member comprises a pivotable battery compartment cover.

3. The device of claim 1 wherein the access member comprises a screw, and wherein the unlatch means comprises a depressable switch operatively engagable with the screw.

4. A releasable door hold open device, comprising:

a latching means for latching a door in an open position, a power supply receiving means, an access member to the power supply receiving means, and unlatch means operatively connected to said access member to unlatch said latching means when the access member is moved in such a manner so as to permit disconnection of power to the power supply receiving means, wherein the access member comprises a pivotable battery compartment cover.

5. A releasable door hold open device, comprising:

a latching means for latching a door in an open position, a power supply receiving means, an access member to the power supply receiving means, and unlatch means operatively connected to said access member to unlatch said latching means when the access member is moved in such a manner so as to permit disconnection of power to the power supply receiving means, wherein the access member comprises a screw, and wherein the unlatch means comprises a depressable switch operatively engagable with the screw.

* * * * *